United States Patent [19]

Mills et al.

[11] Patent Number: 4,867,653

[45] Date of Patent: Sep. 19, 1989

[54] DIAPHRAGM PUMP

[75] Inventors: John B. Mills, St. Paul; Vicky J. Peterson, Robbinsdale; Roger W. Young, Coon Rapids; C. Jeremy Crouch, Bloomington; Roman A. Schulz; Irving F. Snyder, both of Minneapolis; Larry J. DeHemmer, Plymouth, all of Minn.

[73] Assignee: Grace Inc., Minneapolis, Minn.

[21] Appl. No.: 146,472

[22] Filed: Jan. 20, 1988

[51] Int. Cl.[4] ..... F04B 39/14

[52] U.S. Cl. ..... 417/360; 417/572; 222/382; 285/178

[58] Field of Search ..... 417/395, 394, 393, 361, 417/360, 572; 222/383, 382, 401; 285/178; 137/625.27; 184/6.28

[56] References Cited

U.S. PATENT DOCUMENTS

| | | | |
|---|---|---|---|
| 63,648 | 4/1867 | Matthews, Jr. | 92/104 |
| 1,385,019 | 7/1921 | Mathieu | 137/596.2 |
| 2,111,168 | 3/1938 | Chansor | 200/83 |
| 2,283,439 | 5/1942 | Herman | 138/30 |
| 2,548,368 | 4/1951 | Hartley et al. | 141/217 |
| 2,625,886 | 1/1953 | Browne | 417/454 |
| 2,698,766 | 1/1955 | Cox | 297/9 |
| 2,751,935 | 6/1956 | Smith | 137/795 |
| 2,753,804 | 7/1956 | Goss | 417/454 |
| 2,925,828 | 2/1960 | Lieser | 137/625.26 |
| 3,042,266 | 7/1962 | Mies | 222/383 |
| 3,082,851 | 3/1963 | Sheriff et al. | 192/1.35 |
| 3,118,382 | 1/1964 | English | 417/403 |
| 3,142,315 | 7/1964 | Hennels, Sr. | 137/625.6 |
| 3,224,455 | 12/1965 | Alfieri | 137/113 |
| 3,282,294 | 11/1966 | Corniello | 137/624.14 |
| 3,283,784 | 11/1966 | Ruchser | 137/625.64 |
| 3,285,278 | 11/1966 | Corlett | 137/454.2 |
| 3,385,166 | 5/1968 | Kroffke | 91/306 |
| 3,418,002 | 12/1968 | Hennells | 277/188 R |
| 3,559,686 | 2/1971 | Hoffman | 137/625.26 |
| 3,643,548 | 2/1972 | Butterworth | 91/298 |
| 3,849,033 | 11/1974 | Schall | 417/454 |
| 3,968,971 | 7/1976 | Mariaulle | 277/177 |
| 4,005,637 | 2/1977 | Bouyoucos et al. | 91/276 |
| 4,011,795 | 3/1977 | Barthe et al. | 91/286 |
| 4,192,477 | 3/1980 | Decky | 285/178 |
| 4,375,182 | 3/1983 | Zavoda | 92/98 |
| 4,409,886 | 10/1983 | Herner | 91/397 |
| 4,557,669 | 12/1985 | Wanderjagt | 222/383 |

FOREIGN PATENT DOCUMENTS

| | | | |
|---|---|---|---|
| 1055969 | 4/1959 | Fed. Rep. of Germany | 92/104 |
| 331648 | 9/1958 | France | 137/625.27 |

*Primary Examiner*—Carlton R. Croyle
*Assistant Examiner*—Robert N. Blackmon
*Attorney, Agent, or Firm*—Douglas B. Farrow

[57] ABSTRACT

A double-diaphragm pump is designed to be molded almost entirely out of plastic and is provided with totally externally-accessible and serviceable check valves which do not require any significant disassembly of the pump itself. The pump is also fitted with a diaphragm which is formed from a uniform thickness of material and which have convolutions which are equally disposed on either side of the angle of elevation of the unstressed diaphragm. The pump is designed for mounting on top of a barrel or drum and has a set of radiused feet so as to fit snugly against the rim in an inlet pipe which fits into a bung plug having an eccentric opening such that the opening grips the inlet pipe and the plug may be rotated so as to snugly position the pump against the rim of the drum. The air valve to the pump is provided with U-cup seals in the housing. The spool of the pump moves in such a fashion so that the transitional area between the open and closed positions contacts the open end of the U-cup rather than the closed end as is traditional.

1 Claim, 2 Drawing Sheets

DIAPHRAGM PUMP

BACKGROUND OF THE INVENTION

Double-diaphragm air-operated pumps are in general well known. Such pumps are generally well-suited for transferring materials out of drums or other bulk storage units to another location. Such pumps should be easily and inexpensively manufactured, easily serviced and compatible with a large variety of materials as well as having long service life. While diaphragms have been formed of materials having ridges thereon, such construction inevitably leads to the increased use of material in return for the desired service life. It is therefore an object of this invention to provide a diaphragm pump which is easily serviced, inexpensively manufactured, and yet provides excellent service life.

SUMMARY OF THE INVENTION

A double-diaphragm air-operated pump is designed to be molded primarily from plastic for light weight, chemical compatibility and manufacturability reasons. The pump is designed so that the four check valves are easily removable by simply unthreading a plug and lifting out the pieces needed to be cleaned or otherwise serviced. A removable seat holds the ball and in turn is held in place by a wire cage which is in turn held in place by the threaded plug.

The air valve on the pump has a relatively conventional spool, having sections at either end with first and second diameters and a transitional area connecting them. A U-cup is located in the housing of the air valve and the open side of the U-cup faces the larger of the two diameters such that when the transition area first contacts the seal, it is contacting the open end of the U rather than the closed end as is traditional in conventional practice.

The diaphragms that are used in the pump can be formed of a plastic material such as DuPont's Teflon and are generally conical in shape and have an angle of elevation. The plurality of convolutions are disposed on either side of the angle of elevation and the diaphragm is formed of a generally uniform thickness of material. This construction leads to greatly increased service life while minimizing the material needed for molding.

The inlet pipe extends generally downwardly from the base of the pump and passes through a bung having an offset aperture therein. The aperture seals against the inlet pipe and by rotatably positioning the bung plug within the bung hole, the pump may be tightly located against the rim of the drum or other container from which material is being pumped. The feet of the pump are radiused so as to snugly, comfortably fit against the rims of commonly used drums.

These and other objects and advantages of the invention will appear more fully from the following description made in conjunction with the accompanying drawings wherein like reference characters refer to the same or similar parts throughout the several views.

A BRIEF DESCRIPTION OF THE DRAWINGS

DESCRIPTION OF THE PREFERRED EMBODIMENT

Figure 1:
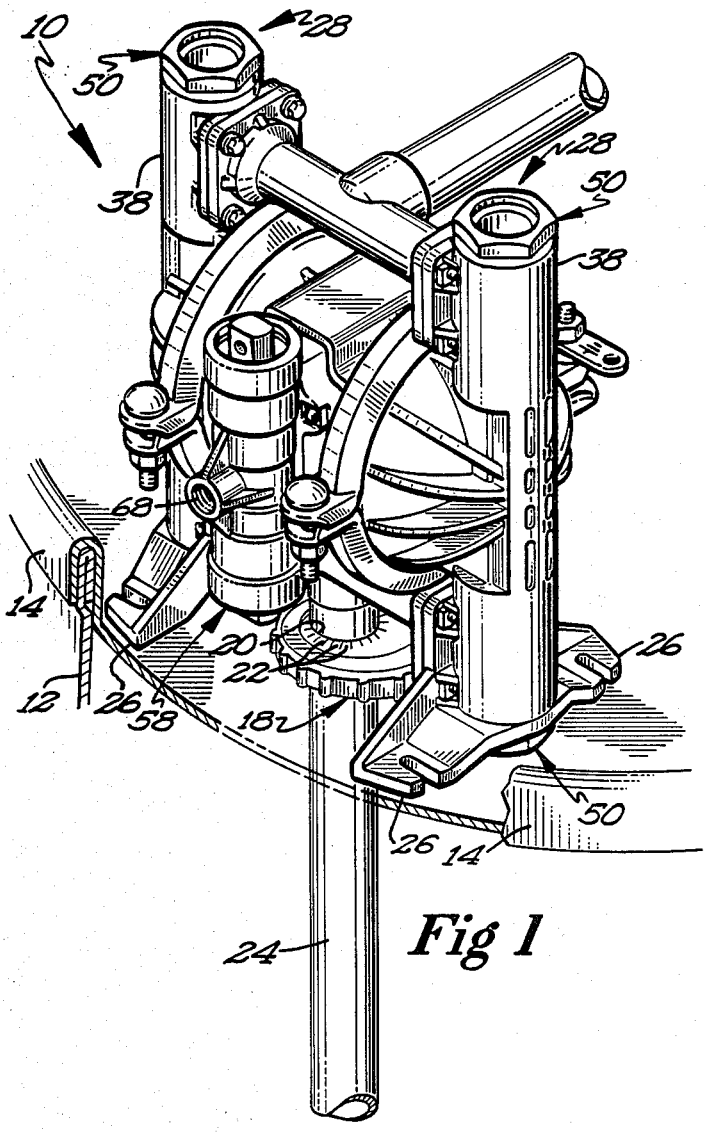
FIG. 1 is a perspective view showing the pump of the instant invention mounts on a drum.
Figure 8:
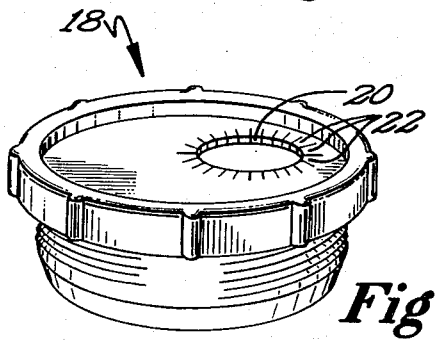
FIG. 8 is a perspective view of the bung plug of the instant invention.
Figure 2:
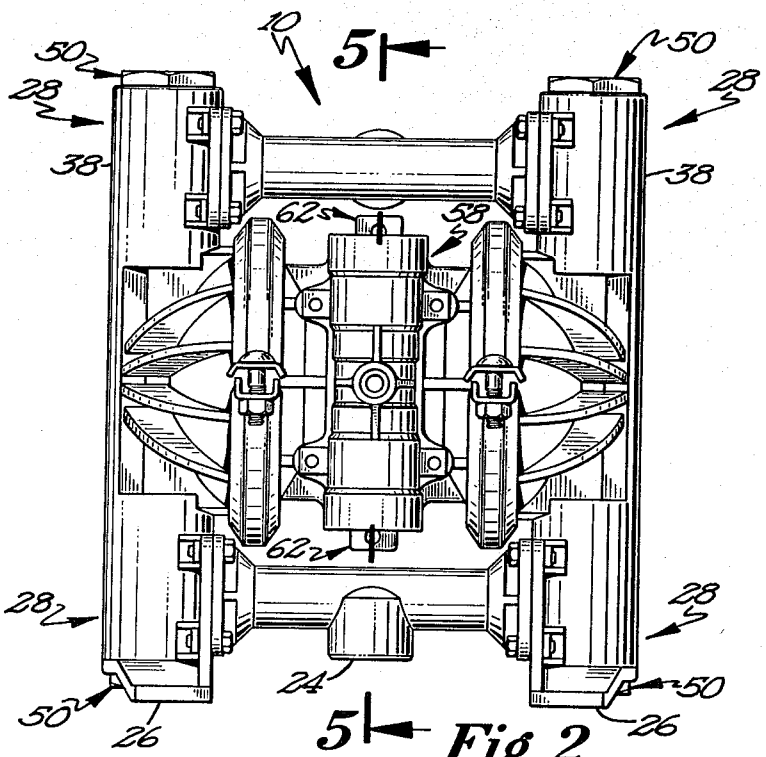
FIG. 2 is a front plan view of the device of the instant invention.

The pump 10 of the instant invention is shown generally in FIG. 1 on top of a drum 12 having a rim 14 and a bung hole 16 therein. A bung plug 18, also part of the instant invention, may be screwably located into aperture 16 and is comprised of an off-center aperture 20 located therein having sealing means 22 in the form of resilient lips which are capable of gripping an inlet pipe 24 which extends downwardly from pump 10. By rotatably positioning bung plug 18 and aperture 16, pump 10 may be positioned against rim 14 such that feet 26 are snugly positioned against rim 14, thereby securely locating pump 10 relative to drum 12. This relationship is also shown in FIGS. 6 and 7 and details of the bung plug are shown in FIG. 8.

Figure 4:
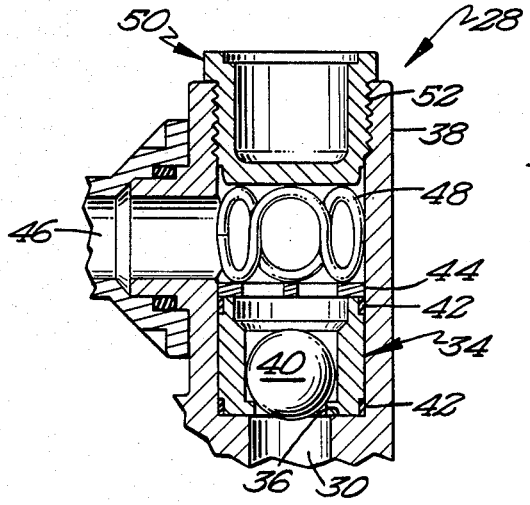
FIG. 4 is a sectional view taken along Line 4—4 of FIG. 3.

In general, dobule-diaphragm pump 10 is conventional in nature and generally well-known with the exception of those features explicitly discussed herein. The pump is designed to be particularly suited for molding from a plastic material. Toward that end several features may be incorporated therein. In particular, the check valves 28 are shown in particular detail in FIGS. 4 and 6. In particular, a first passageway 30 connects with the pumping chamber 32. Located in first passageway 30 is a ball cage 34 which rests on a step 36 in the outer housing 38 of pump 10. Cage 34 has an inner bore which is sized to receive check ball 40. Seals 42 assure that nothing will leak around the check valve assembly 28. A perforated plate 44 lies on top of ball cage 34 and retains ball 40 in position. A second passageway 46 intersects first passageway 30 and at the intersection thereof, a cage member 48 serves to allow fluid passage at the junction of the two passageways and yet causes the retention of perforated plate 44 and ball cage 34 in place. Cage 38 is held in place by a threadably plug 50 which is threaded into position in housing 38 by means of threads 52. Thus, when it is desired to service or replace the check valve assembly 28, plug 50 is simply unscrewed, cage 48 removed and perforated plate 44 and cage 34 removed along with check ball 40. Where necessary the components may be replaced, cleaned or otherwise serviced. This is in distinction from current diaphragm pump practice which requires substantial disassembly of the pump in order to get at the check valves. Of course, reassembly takes place in the opposite sequence.

Figure 6:
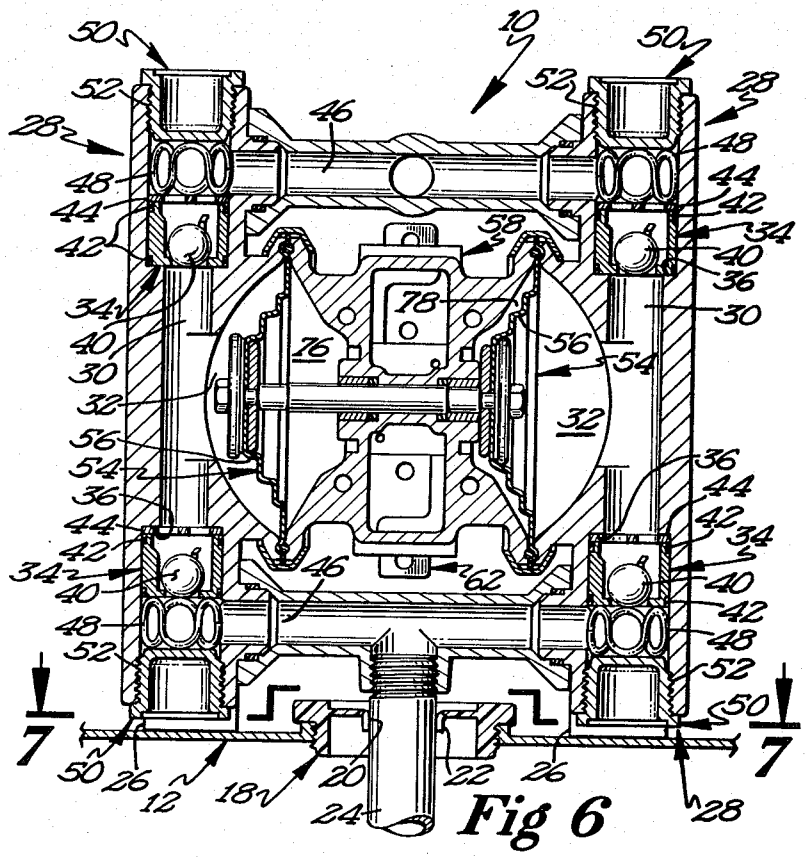
FIG. 6 is a sectional view taken along Line 6—6 of FIG. 3.
Figure 7:
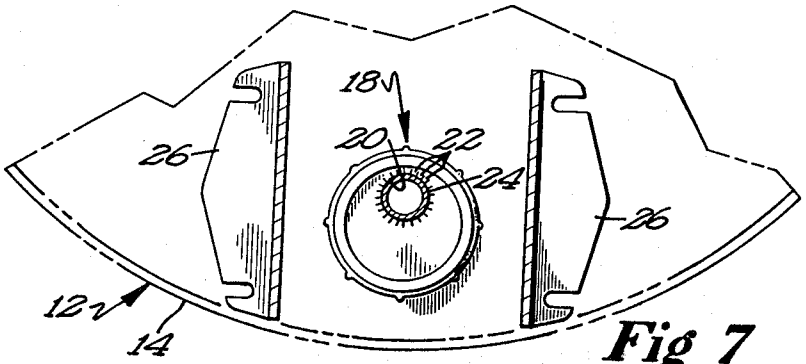
FIG. 7 is a sectional view taken along Line 7—7 of FIG. 6.

The diaphragm 54 is shown in FIG. 6 and is generally conical in shape and has an angle of elevation $\phi$ on which are disposed on either side a plurality of convolutions 56. Diaphragm 54 is formed from a generally planar sheet of material having substantially equal thickness across the surface thereof.

Figure 5:
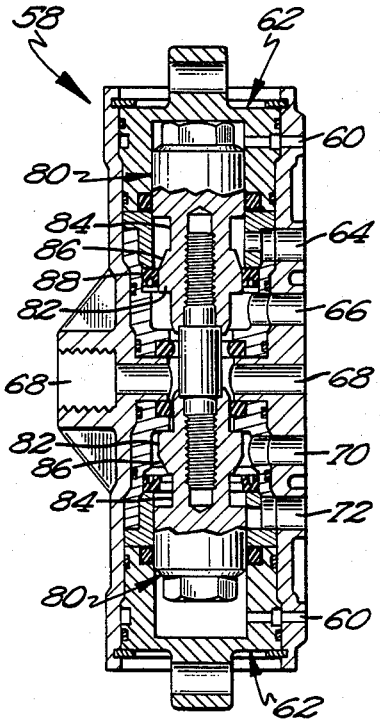
FIG. 5 is a sectional view taken along Line 5—5 of FIG. 2.
Figure 3:
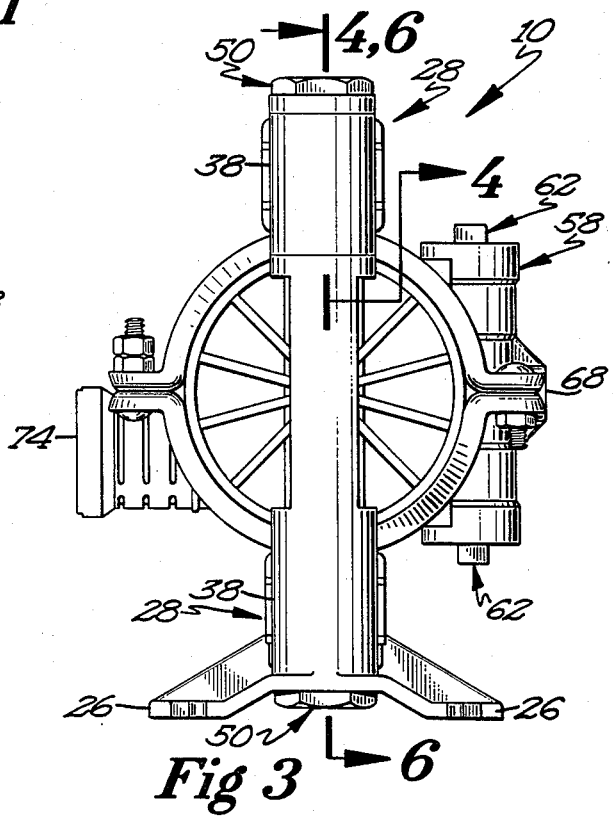
FIG. 3 is an end plan view of the device of the instant invention.

The air valve 58 is shown in detail in FIG. 5. Air valve 58 is initially operated by a pilot valve (not shown). Such a pilot valve may be of any conventional type as is well-known in the art and provides signals through pilot ports 60 in housing 62. Housing 62 is also provided with ports 64, 66, 68, 70 and 72. Port 68 is connected to a source of pressurized air which will operate the pump. Ports 64 and 72 are both connected to the exhaust which may be a muffler such as that shown at 74 in FIG. 3. Ports 66 and 70 are connected respectively to the air side of diaphragms 54 in A and B air chambers 76 and 78 respectively. Thus, as shown in FIG. 5, port 70 is connected with port 72, thereby exhausting the B side 78 of pump 10. Similarly, the A side 76 through port 66 is pressurized by pressurized air from passageway 68. As spool 80 shifts downwardly from the position shown in FIG. 5, the converse connection will take place with ports 68 and 70 connected and ports 64 and 66 connected. In particular, spool 80 has at two locations a first larger diameter 82 and a second smaller diameter 84 connected by a transition area 86. U-cup seals are located in the housing 62 and face towards the center port 68 of air valve 58. That is, when contacting the transition 86, each seal 88 faces the first larger diameter 82. This construction provides an effective long-life sealing mechanism and yet is in contrast to the norm used in the art wherein such seals are generally located in the opposite direction from that shown.

It is contemplated that various changes and modifications may be made to the diaphragm pump without departing from the spirit and scope of the invention as defined by the following claims.

What is claimed is:

1. A pump for mounting on a drum having a rim and an opening, said pump comprising a housing;

at least two feet depending downwardly from said housing, said feet being radiused to conform to and securely fit within said rim;

an inlet tube depending downwardly from said housing; and a bung plug threadedly engageable with said opening and comprising an aperture in said bung plug offset from the center thereof, said aperture including means to snugly grip and seal said inlet tube whereby said pump can be securely positioned against said rim of said drum by rotating said bung plug so as to position and press feet against said rim.

* * * * *

UNITED STATES PATENT AND TRADEMARK OFFICE

CERTIFICATE OF CORRECTION

PATENT NO. : 4,867,653

DATED : September 19, 1989

INVENTOR(S) : Mills et al

It is certified that error appears in the above-identified patent and that said Letters Patent is hereby corrected as shown below:

On the title page:

Assignee: Graco Inc., Minneapolis, Minn.

Signed and Sealed this

Thirty-first Day of July, 1990

*Attest:*

HARRY F. MANBECK, JR.

*Attesting Officer*

*Commissioner of Patents and Trademarks*